US010196832B2

(12) United States Patent
Azizinamini

(10) Patent No.: US 10,196,832 B2
(45) Date of Patent: Feb. 5, 2019

(54) HIGH PERFORMING PROTECTIVE SHELL FOR CONCRETE STRUCTURES

(71) Applicant: Atorod Azizinamini, Miramar, FL (US)

(72) Inventor: Atorod Azizinamini, Miramar, FL (US)

(73) Assignee: THE FLORIDA INTERNATIONAL UNIVERSITY BOARD OF TRUSTEES, Miami, FL (US)

( * ) Notice: Subject to any disclaimer, the term of this patent is extended or adjusted under 35 U.S.C. 154(b) by 18 days.

(21) Appl. No.: 15/615,361

(22) Filed: Jun. 6, 2017

(65) Prior Publication Data

US 2017/0268245 A1 Sep. 21, 2017

Related U.S. Application Data

(63) Continuation of application No. 14/984,708, filed on Dec. 30, 2015, now Pat. No. 9,708,821.

(51) Int. Cl.
*E04G 23/02* (2006.01)

(52) U.S. Cl.
CPC ..... *E04G 23/0211* (2013.01); *E04G 23/0218* (2013.01)

(58) Field of Classification Search
USPC ..... 264/36.2, 333; 405/257, 274, 277, 279
See application file for complete search history.

(56) References Cited

U.S. PATENT DOCUMENTS 1,905,405 A * 4/1933 Winslow ..... E04G 23/0203 52/514
1,926,415 A * 9/1933 Wertz ..... E04G 23/0203 118/410
5,226,279 A * 7/1993 Rendon-Herrero ..... C04B 41/009 52/741.41
5,426,973 A 6/1995 Hyatt
5,619,836 A * 4/1997 Rouch ..... E04G 23/0203 52/715
5,878,540 A * 3/1999 Morstein ..... E02D 27/42 52/292
6,219,986 B1 * 4/2001 Ouchi ..... E04G 23/0218 52/425
6,386,236 B1 * 5/2002 Buckley ..... F16L 55/1686 138/97
7,347,227 B2 * 3/2008 Zivanovic ..... B28B 21/62 138/172
8,256,174 B2 * 9/2012 Irniger ..... E04H 12/12 52/223.3
8,881,485 B2 11/2014 Hartt
8,974,598 B2 3/2015 Fonollosa et al.
2015/0167332 A1 * 6/2015 Shiota ..... E04G 23/0218 52/514

* cited by examiner

*Primary Examiner* — Brian E Glessner
*Assistant Examiner* — Adam G Barlow
(74) *Attorney, Agent, or Firm* — Saliwanchik, Lloyd & Eisenschenk

(57) ABSTRACT

The subject invention provides materials and methods for repairing and/or improving the performance of concrete structures. In preferred embodiments, the methods comprise attaching a thin shell of ultra-high performance concrete (UHPC) over the area of interest, the shape of the shell substantially conforming to that of the area itself, and subsequently filling a cavity defined by the shell with UHPC.

16 Claims, 4 Drawing Sheets

HIGH PERFORMING PROTECTIVE SHELL FOR CONCRETE STRUCTURES

CROSS-REFERENCE TO RELATED APPLICATION

This application is a continuation application of U.S. application Ser. No. 14/984,708, filed Dec. 30, 2015, the disclosure of which is hereby incorporated herein by reference in its entirety, including any figures, tables, and drawings.

GOVERNMENT SUPPORT

This invention was made with government support under contract number DTRT13-G-UTC41 awarded by the U.S. Department of Transportation. The government has certain rights in the invention.

BACKGROUND OF INVENTION

Reinforced concrete is a widely-accepted material of construction. Severe deterioration of many reinforced concrete structures has been observed with increasing frequency throughout the United States. This problem is widespread, affecting not only transportation infrastructure components, but also "snowbelt" structures, as well as coastal buildings and related structures. The safety and longevity of such reinforced concrete structures are of prime concerns, and methods of protection are therefore important.

The basic problem associated with the deterioration of conventional reinforced concrete due to corrosion of embedded reinforcement is generally not that the reinforcing material itself is reduced in mechanical strength, but rather that the concrete cracks. Concrete contains pores that are interconnected throughout its structure, and this extensive network leads to permeability of the concrete to both liquids and gases. This is of critical importance in the corrosion process, because both the initiators (generally, chloride ion) and the supporters (for example, oxygen) of corrosion of the reinforcing steel must diffuse through the overlying concrete to the steel. Chlorides from natural sources such as salt water or application of deicing salts can penetrate concrete and attack the reinforcing steel of a bridge structural element.

Cracking of concrete can lead to problems regarding structural soundness (on, for example, pilings), to discomfort (for example, chuckholes in bridges), or to cosmetic problems (as in the case of facades on buildings). As an example, many elements of bridge structures are exposed to harsh environmental conditions. Consequently, the service life of bridges is often reduced. The number of deficient bridges needing repair as a result is enormous. There are more than 600,000 bridges in U.S. and about 25% of them need retrofit or replacement.

Certain additives have been used in attempts to improve the performance of reinforced concrete. Latex-modified concrete essentially uses a polymer emulsion in the mix-water which apparently impedes the penetration of surface chlorides into the concrete (and possibly oxygen diffusion through the concrete as well). Incorporation of wax compounds has also been used to create "internally sealed" concrete. In this approach, a heating cycle is employed following curing of the cement to form a hydrophobic layer of wax to form on the pore walls, which prevents ingress of surface chemicals.

More recently, ultra-high performance concrete (UHPC) has become an important structural material. UHPC benefits from being a "minimum defect" material a material with a minimum amount of defects such as micro-cracks and interconnected pores with a maximum packing density. Several types of UHPC have been developed in different countries and by different manufacturers. The four main types of UHPC are compact reinforced composites (CRC), multi-scale cement composite (MSCC), and reactive powder concrete (RPC). RPC is the most commonly available UHPC and one such product is currently marketed under the name Ductual® by Lafarge, Bouygues and Rhodia.

Portland cement is the primary binder used in conventional UHPC, but at a much higher proportion as compared to ordinary concrete or HPC. High proportions of tricalcium aluminate ($C_3A$) and tricalcium silicate ($C_3S$), and a lower Blaine fineness are desirable for conventional UHPC. The addition of silica fume serves to increase particle packing, flowability due to spherical nature, and pozzolanic reactivity with calcium hydroxide. Quartz sand with a maximum diameter of about 600 μm is the largest constituent aside from the steel fibers. Both the ground quartz (about 10 μm) and quartz sand contribute to the optimized packing by reducing the amount of water necessary to produce a fluid mix, and therefore, permeability, while polycarboxylate superplasticizer contributes to improving workability and durability. Finally, the addition of steel fibers aids in preventing the propagation of micro-cracks and macro-cracks and thereby limits crack width and permeability. Description of UHPC compositions can be found at, for example, U.S. Pat. Nos. 8,881,485 and 8,974,598 each of which is incorporated herein, in its entirety, by reference.

Current technology for repairing bridges typically involves removing the damaged concrete and reinforcing steel, and rebuilding and/or repairing the damaged area by replacing the steel and concrete. It is a time-consuming process, and may also result in significant impact to the traveling public during, for example, bridge closures caused by repair process.

Other available techniques employ fiber reinforced polymer, or FRP, sheets that wrap around the bridge elements needing repairs. One disadvantage of using FRP is that for flat surfaces, the repair procedures are cumbersome. Moreover, the material properties of FRP are very different from those of concrete, inevitably resulting in major structural challenges.

Development of a method to easily and quickly repair damaged structural elements is desirable for lowering the cost and improving the service life of bridges and other structures.

BRIEF SUMMARY

The subject invention provides materials and methods for repairing and/or improving the performance of concrete structures. In exemplified embodiments, the structures are bridges.

In preferred embodiments, the methods comprise attaching a thin shell of ultra-high performance concrete (UHPC) over an area of interest, the shape of the shell substantially conforming to the shape of the area of interest, and subsequently filling a space between the shell and the damaged area with a bonding agent such as, for example, grout, epoxy, or concrete. [A1].

Thus, in one aspect, the subject invention provides a method of repairing, or otherwise improving the performance of, a concrete structure, comprising:

preparing an area of the structure needing repair and/or improvement by, preferably, cleaning and roughening the surface thereof;

providing a concrete shell having a shape such that, when applied to the surface of the area of interest, the shell defines a cavity conforming to that area;

placing the concrete shell adjacent to, or against, the surface of the area of interest (or adjacent to, or against, a curtilage surrounding that area), such that the area of interest is substantially covered by the shell and, optionally, separating the shell from the area of interest by using one or more positioning elements that help create, and/or maintain, a cavity adjacent to the area of interest;

attaching the shell to the area of interest (or to the curtilage) by one or more fasteners and/or sealing the junction between the shell and the area (or the curtilage);

injecting concrete, grout or epoxy into the cavity between the shell and the area of interest.

In preferred embodiments, the concrete shell comprises UHPC and has a thickness between about 1/32 of an inch and 2 inches and, preferably, between about 1/16 of an inch and about 2 inches. Advantageously, the UHPC shells provided herein can be cast into a variety of shapes and sizes according to their intended applications. In one embodiment, the shell is produced by 3-D printing.

In preferred embodiments, the junction is sealed by applying a bonding agent. Some embodiments provide that the bonding agent is any adhesive common for bonding concrete. In some embodiments, the step of fastening the shell to the surface will effect the necessary sealing.

The shell may be, for example, from 1 foot to 8 feet in length and from 6 inches to 20 feet in width. More commonly, the shell will be from 1 foot to 6 feet in length and width. The shell may be for ¼ inch to 2 feet in depth.

In some embodiments, the positioning elements, or spacers, are at least about ¼ of an inch in length. The shell is attached to the area needing repair and/or protection by, for example, conventional or powder-actuated fasteners. In certain embodiments, a fastener is driven into the concrete structure through a positioning element. In an exemplary embodiment, the fasteners can be spaced apart at an interval of about 12 inches.

In another aspect, the subject invention provides a method of enhancing the performance of a concrete structure, comprising attaching a thin shell of UHPC in a manner substantially the same as the method of repairing damage as described above.

In another embodiment, the subject invention provides the UHPC shells that can be used in the methods of the subject invention. These shells are adapted to be attached to areas where there is damaged concrete, to the curtilage surrounding the damaged area, or to build a cofferdam in damaged areas around splash zones.

Advantageously, the subject invention provides a convenient solution to repair, reinforce, and/or improve the structural integrity of a wide range of concrete elements including those present in, for example, bridges, highways, overpasses, docks, piers, and other load-bearing structures that may be susceptible to environmentally (or other) compromising conditions.

DETAILED DESCRIPTION

Figure 1:
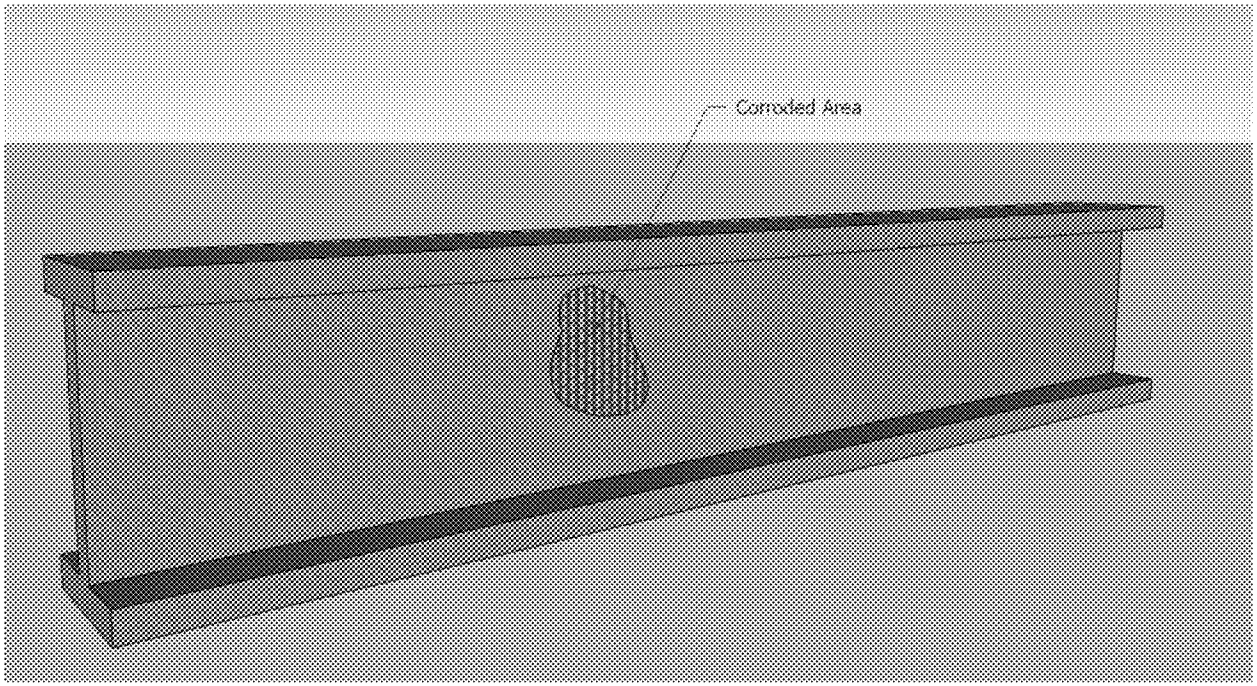
FIG. 1 shows a concrete beam exposing a corroded area needing repair.
Figure 2:
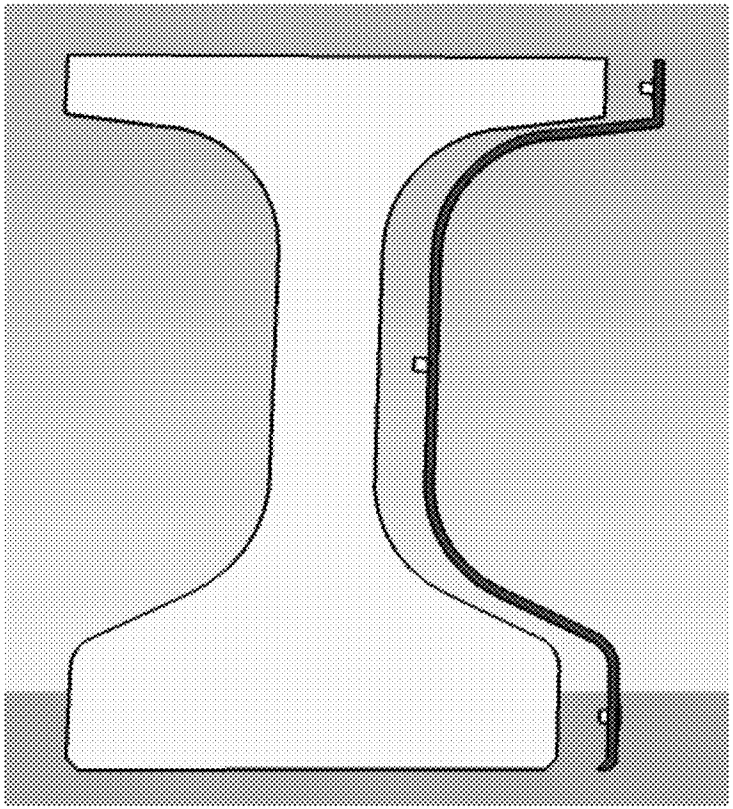
FIG. 2 shows a cross-section of the beam covered by a concrete shell, which is separated from the beam's surface by spacers.
Figure 3:
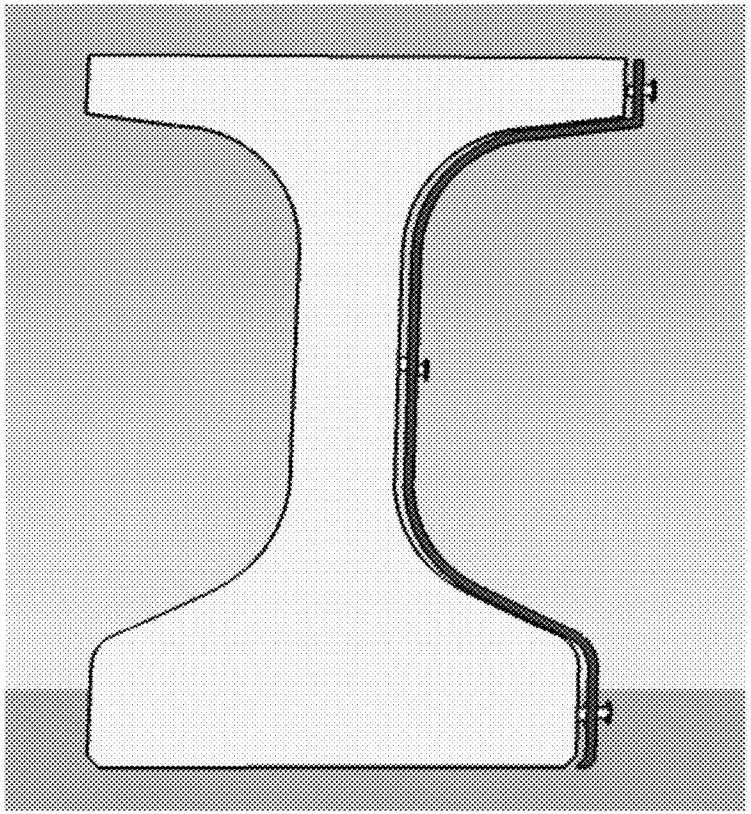
FIG. 3 shows the shell being attached to the beam's surface with fasteners installed through the spacers.
Figure 4:
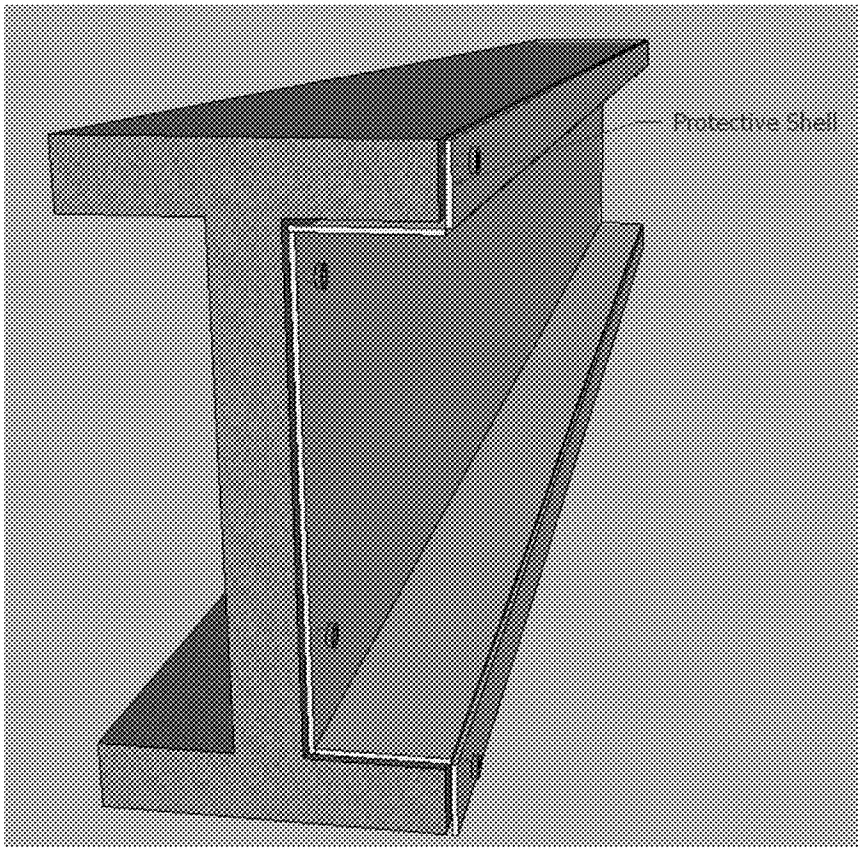
FIG. 4 is a 3-D depiction of the beam installed with the shell unit and injected with a bonding agent.

The subject invention provides materials and methods for repairing and/or improving the performance of concrete structures. In specific embodiments, the methods comprise attaching a thin shell of ultra-high performance concrete (UHPC) over an area of interest, the shape of the shell substantially conforming to the shape of the area of interest, and subsequently filling the shell with a bonding agent such as, for example, grout, epoxy, or concrete.

Advantageously, embodiments detailed herein provide a convenient solution to repair, reinforce, and/or otherwise improve the structural integrity of a variety of concrete elements present in, for example, bridges, highways, overpasses, docks, piers, and other load-bearing structures that may be susceptible to environmentally (or otherwise) compromising conditions.

In one aspect, the subject invention provides a method for repairing, and/or improving the performance of, an area (the area of interest) of a concrete structure, comprising:

preparing an area of the structure needing repair and/or improvement by, preferably, cleaning and roughening the surface thereof;

providing a concrete shell having a shape such that, when applied to the surface of the area of interest, the shell defines a cavity conforming to that area;

placing the concrete shell adjacent to, or against, the surface of the area of interest (or adjacent to, or against, a curtilage surrounding that area), such that the area of interest is substantially covered by the shell and, optionally, separating the shell from the area of interest by using one or more positioning elements that help create, and/or maintain, a cavity adjacent to the area of interest;

attaching the shell to the area of interest (or to the curtilage) by one or more fasteners and/or sealing the junction between the shell and the area (or the curtilage);

injecting concrete, grout and/or epoxy into the cavity between the shell and the area of interest.

In one embodiment, the concrete injected into the cavity has substantially the same composition as the shell.

The shell of the subject invention is, preferably, a manufactured precast or prefabricated structure capable of containing a mass of concrete. The shell not only provides load support to the finished structure but also serves as a component of the structure. In some embodiments, the subject invention provides a shell for repairing and/or retrofitting damaged concrete structures including, but not limited to, bridges, highways, overpasses, docks, piers, and elevated roadway supports.

In certain embodiments, damage that can be repaired by the protective shell are caused by environmental corrosion or physical impact. In other embodiments, damage can also be a result of dynamically applied loads typically experienced by load-bearing structural elements such as piles, beams, columns, and bent caps.

In some embodiments, the area needing repair comprises reinforcing steel, which can be structurally compromised following the penetration of corrosive agents through the porous concrete structure. The use of UHPC in accordance with the subject invention is particularly advantageous because UHPC is a very strong and ductile concrete that also has extremely low permeability. Chloride intrusion is effectively stopped, due to the very low permeability, thus protecting the structure from additional damage. The inherent strength of the shell provides additional strength and reinforcement to the structure.

Thus, in a preferred embodiment of the subject invention the concrete shell comprises UHPC. In one embodiment, the shell is produced by 3-D printing using UHPC. In an exemplary embodiment, shells comprising UHPC can be in a jigsaw form such that they can be disposed in connection with one another to cover structures of various shapes and sizes.

The thickness of the UHPC shell of the subject invention can be about ½ inch or less. In preferred embodiments, the UHPC shell has a thickness of between about 1/16 and about ¼ of an inch. The high compressive strengths inherent to UHPC make it possible to manufacture thin shells that are strong, light-weight and cost effective. Further, thin shells are easy to handle, rendering the production and installation of shells of various shapes and sizes possible. As a result, in accordance with the subject invention, UHPC shells can be custom-made into desired shapes and thicknesses according to their intended purposes.

Certain embodiments of the subject invention provide that the UHPC shells can be manufactured in the form of jigsaw elements, which can, in turn, be disposed in connection with one another to form shapes that are otherwise difficult to achieve via conventional casting methods.

Conventional UHPC provides compressive strengths from about 120 to 400 MPa, tensile strength from about 10 to 30 MPa, and modulus of elasticity from about 60 to 100 GPa. In addition to cement and aggregates, UHPC formulations generally comprise supplementary materials including, for example, fibers and organic admixtures, which are generally smaller in size than the cement grains. Furthermore, UHPC is ductile and has extremely low permeability to corrosive chemicals. The unusually high ductility of UHPC provides support under flexural and tensile loads, even after initial cracking, making it an advantageous candidate for structural applications. In some embodiments, the shell comprises a curved surface such that the edges of the shell can be attached flush with the damaged surface to be repaired.

In specific embodiments, the subject invention provides UHPC shells for retrofitting structural elements employed in bridges, which are frequently subjected to harsh environments. Salt water, with its high content of chloride ion, is a particularly important environmental factor that can significantly compromise the structural integrity of bridge elements. In addition to repairing and reinforcing the already-damaged concrete structures, the inherent strength and chemical impermeability of UHPC shells can be used according to the subject invention to provide protection against future corrosion. Thus, when the subject disclosure refers to, for example, a damaged area, it should be understood, unless the context dictates otherwise, that the area may be one for which it is desired to avoid damage.

In one embodiment, the method of the subject invention involves testing the concrete structure to identify damage, or the potential to develop damage, before the shell of the subject invention is applied. The testing may involve, for example, the use of ultrasound or other sonic procedures, and/or mechanical or chemical tests such as that described in U.S. Pat. No. 5,426,973, which is incorporated herein, in its entirety, by reference. If damage, or the potential for damage, is detected then the method of the subject invention can be implemented, even in the absence of visual evidence of damage.

In certain embodiments, the structure is tested after the application of the shell and enclosed cement in order to measure and/or confirm repair of damage and/or other improvement of performance. Such testing can involve standard tests, known to those skilled in the art, for testing concrete performance.

In some embodiments, the damaged area requires removal of excess surface materials, followed by roughening the surface prior to attaching the UHPC shell. These excess materials can be external contamination, loose or spalled concrete from a damaged structure, and/or rust from exposed reinforcing steel. In certain embodiments, both the surface of the damaged area and the surface of the shell in contact with the damaged area are roughened in order to improve bonding between each surface and the injected UHPC.

In certain embodiments, the shell may be placed, for example, about 12 inches above and below a damaged area, with the cavity being formed adjacent to the damaged area, such that, when concrete fills the cavity, it covers the damaged area and, optionally, the area adjacent to the damaged area.

In some embodiments, the installation of a UHPC shell to an area needing repair requires the placement of one or more positioning elements, or spacers, to create, and/or maintain a cavity between the shell and the damaged surface for the injection of UHPC. Depending upon the shape and the size of the damaged area, two or more positioning elements may be necessary to stabilize the shell against the surface of the damaged area. Because the positioning elements will become an integral component of the protective shell unit following the injection and curing of UHPC, preferred embodiments provide that the positioning elements comprise materials that are non-corrosive in the environment for which the structure is intended. Further, certain embodiments of the subject invention provide that the positioning elements can be as short as about ¼ of an inch in length and substantially identical to one another.

In some embodiments, the shell is attached to the area needing repair by one or more fasteners. In certain embodiments, each fastener is driven into the concrete structure through a positioning element. In exemplary embodiments, the fasteners can be nails, bolts, or any other fasteners commonly employed in the art, and are applied either conventionally or by means of powder-actuation. In certain embodiments, the shell has formed therein at least one opening through which a fastener can be inserted.

The bonding agent for filling the shell cavity and for sealing the space around the edge of the attached shell can be any adhesive conventional for bonding concrete. In preferred embodiments, the bonding agent is grout or epoxy.

In some embodiments, attachment of a thin shell of UHPC to a concrete structure can serve to protect the structure from corrosive agents such as chloride, as well as to improve the strength of the structure under load-bearing conditions.

All patents, patent applications, provisional applications, and publications referred to or cited herein are incorporated by reference in their entirety, including all figures and tables, to the extent they are not inconsistent with the explicit teachings of this specification.

It should be understood that the examples and embodiments described herein are for illustrative purposes only and that various modifications or changes in light thereof will be suggested to persons skilled in the art and are to be included within the spirit and purview of this application.

What is claimed:

1. An apparatus, adapted to be attached over an area of interest on a concrete structure, the apparatus comprising:

a ultra high performance concrete (UHPC) shell having a first side and a second side for placing towards at least the area of interest, the shell having a thickness of about 1/32 of an inch to about 2 inches; and one or more positioning elements operably connected to and projecting from the second side of the shell to inhibit the second side from contacting at least the area of interest, thereby forming a cavity adapted to receive a bonding agent;

an opening through the one or more positioning elements, adapted to receive a fastener from the first side of the shell to secure the shell to the concrete structure;

such that, when the cavity is filled with the, bonding agent, at least the area of interest is sealed.

2. The apparatus, according to claim 1, wherein the shell is from 1 foot to 8 feet in length and from 6 inches to 20 feet in width.

3. The apparatus, according to claim 1, wherein the shell has a thickness from 1/16 inch to 1/4 inch.

4. The apparatus, according to claim 1, wherein the UHPC has a strength of from 120 to 400 Mpa, tensile strength from about 10 to 30 Mpa, and modulus of elasticity from about 60 to 100 GPa.

5. A kit comprising an apparatus, according to claim 1, and one or more further components selected from bonding agents and one or more fasteners.

6. A concrete structure having attached thereto an apparatus of claim 1.

7. The apparatus, according to claim 1, wherein the positioning elements have a length of about 1/4 inch.

8. The apparatus, according to claim 1, wherein the bonding agent is injected into the cavity.

9. An apparatus, adapted to be attached over an area of interest on a concrete structure, the apparatus comprising two or more ultra high performance concrete (UHPC) shells for connection with each other and over an area of interest, each shell having a first side, a second side for placement towards the area of interest, and a thickness of about 1/32 of an inch to about 2 inches; and one or more positioning elements operably connected to and projecting from the second side of each shell to inhibit the second side from contacting at least the area of interest, thereby forming a cavity, adapted to receive a bonding agent;

an opening through the one or more positioning elements, adapted to receive a fastener from the first side of the shell to secure the shell to the concrete structure;

such that, when the cavity is filled with the bonding agent, at least the area of interest is sealed to the shell.

10. The apparatus, according to claim 9, wherein each shell is from 1 foot to 8 feet in length and from 6 inches to 20 feet in width.

11. The apparatus, according to claim 9, wherein each shell has a thickness from 1/16 inch to 1/4 inch.

12. The apparatus, according to claim 9, wherein the UHPC has a strength of from 120 to 400 Mpa, tensile strength from about 10 to 30 Mpa, and modulus of elasticity from about 60 to 100 GPa.

13. A kit comprising an apparatus, according to claim 9, and one or more further components selected from bonding agents and one or more fasteners.

14. A concrete structure having attached thereto an apparatus of claim 9.

15. The apparatus, according to claim 9, wherein the bonding agent is injected into the cavity.

16. The apparatus, according to claim 9, wherein the two or more shells are arranged in an overlapping fashion.

* * * * *